US007625150B2

(12) United States Patent
Wu

(10) Patent No.: US 7,625,150 B2
(45) Date of Patent: Dec. 1, 2009

(54) TOOTHBRUSH

(76) Inventor: Yun-foo Wu, Flat G, 4/F., Hong Shun Court, Sun Hing Garden, Tai Po, NT, Hong Kong (CN)

( * ) Notice: Subject to any disclaimer, the term of this patent is extended or adjusted under 35 U.S.C. 154(b) by 600 days.

(21) Appl. No.: 10/597,118

(22) PCT Filed: Jan. 12, 2005

(86) PCT No.: PCT/CN2005/000036

§ 371 (c)(1),
(2), (4) Date: Jul. 12, 2006

(87) PCT Pub. No.: WO2005/074744

PCT Pub. Date: Aug. 18, 2005

(65) Prior Publication Data

US 2007/0127981 A1 Jun. 7, 2007

(30) Foreign Application Priority Data

Jan. 17, 2004 (CN) ..... 2004 1 0000827

(51) Int. Cl.
*A47L 13/22* (2006.01)

(52) U.S. Cl. ..... 401/281; 401/280; 401/275; 401/190; 401/282

(58) Field of Classification Search ..... 401/188 R, 401/268, 270, 272, 273, 274, 275, 277, 278, 401/279, 280, 281, 282, 291, 190
See application file for complete search history.

(56) References Cited

U.S. PATENT DOCUMENTS

| | | | | |
|---|---|---|---|---|
| 3,937,235 | A | 2/1976 | Broughton | 132/84 B |
| 4,467,822 | A * | 8/1984 | Blackwell | 401/175 |
| 6,050,736 | A | 4/2000 | Gonzalez | 401/281 |

FOREIGN PATENT DOCUMENTS

| | | |
|---|---|---|
| CN | 2297905 Y | 11/1998 |
| GB | 2284982 | 6/1995 |
| WO | WO 98/17146 | 4/1998 |

* cited by examiner

*Primary Examiner*—David J Walczak
(74) *Attorney, Agent, or Firm*—Allen, Dyer, Doppelt, Milbrath & Gilchrist, P.A.

(57) ABSTRACT

A toothbrush has a toothbrush head, a toothbrush bar and a toothpaste container. The toothpaste container is a gas-filled container, and a gas nipple is provided at the bottom of the toothpaste container. A pipe channel is provided in the toothbrush bar, the toothpaste container is communicated with the toothbrush head through the pipe channel via a valve. The toothbrush bar is hinged to the toothpaste container by a spherical hinged joint formed by the end of the toothbrush bar. The spherical hinged joint controls the valve to discharge toothpaste in the toothpaste container into the pipe channel and the toothbrush head. The invention is convenient especially for children, the elder, the blind and the disabled.

16 Claims, 4 Drawing Sheets

TOOTHBRUSH

TECHNICAL FIELD

The present invention relates to daily use goods, and more particularly to a toothbrush.

BACKGROUND OF THE INVENTION

The existing toothbrushes which are separated from toothpaste sometimes are inconvenient to use for certain people, such as children, the elder, the blind and the disabled. Although there are some toothbrushes integrated with toothpaste, they have shortcomings in practical use, such as being difficult to control when squeezing out the toothpaste.

SUMMARY OF THE INVENTION

The object of the present invention is to provide a toothbrush integrated with toothpaste which is easy to control so as to overcome the disadvantage of being inconvenient to use in the prior art.

The technical solution of the present invention is that, a toothbrush comprises a toothbrush head, a toothbrush bar, and a toothpaste container which is connected with the toothbrush bar, wherein the toothbrush bar has a pipe channel, and the toothbrush container is communicated with the toothbrush head through the pipe channel via a first valve, and wherein the toothbrush bar is hinged with the toothbrush container by a spherical hinged joint formed by the end of the toothbrush bar, and the spherical hinged joint controls the opening or closing of the first valve.

Said toothbrush container is a pressurized container.

Said toothbrush container is a gas-filled container, with a gas nipple at the bottom of the container, and wherein a toothpaste bag, which is a compressible soft bag, is located inside the container.

Inside said toothbrush head is further provided with a vane valve for controlling the opening or closing of the pipe channel.

Said spherical hinged joint has at least a protruding lip located at its rear end, and the protruding lip controls the opening or closing of the first valve when the toothbrush bar is rotated with respect to the toothbrush container.

Said first valve is a ball valve in which the ball is disposed at the exit of the toothbrush container, and the protruding lip drives the ball to move when the toothbrush bar is rotated.

Said spherical hinged joint is equipped with a leakproof ring.

A positioning spring is provided to enable a reset of the toothbrush bar by a relative rotation between the toothbrush bar and the toothbrush container.

An adjusting button is provided for adjusting the relative slanting angle between the toothbrush bar and the toothbrush container.

The beneficial effect of the present invention is in that: in the present invention, the toothbrush bar is hinged with the toothpaste container by a spherical hinged joint formed by the end of the toothbrush bar, and the spherical hinged joint controls the opening or closing of the first valve. Since the spherical hinged joint can be operated flexibly, in practical use, the easy operation of opening or closing of the first valve allows for squeezing out toothpaste easily and controlling the discharged amount easily, so as to overcome the disadvantage of being difficult to operate in the prior art. The toothbrush of the present invention is very convenient for certain people, such as children, the elder, the blind and the disabled. Particularly, since the opening or closing of the first valve is controlled by a protruding lip located at the rear end of the spherical hinged joint, the structure is simple, and it is extremely convenient to operate the toothbrush with a single hand, thus the present invention is very practicable. A leakproof ring is provided in the spherical hinged joint to prevent the leakage of toothpaste from the ball valve, which improves the reliability of the present invention. A positioning spring is provided to enable a reset of the toothbrush bar by a relative rotation between the toothbrush bar and the toothbrush container. Moreover, an adjusting button is provided for adjusting the relative slanting angle between the toothbrush bar and the toothbrush container. In use, the discharged amount of toothpaste can be adjusted by operating the adjusting button so as to set the toothbrush bar to an appropriate slanting angle with respect to the toothpaste container on demand, thus the practicability of the present invention is further improved. And a vane valve for controlling the opening or closing of the pipe channel in the toothbrush head can effectively prevent the leakage of toothpaste from the toothbrush head when not in use, which further improves the reliability of the present invention.

DETAIL DESCRIPTION OF THE PREFERRED EMBODIMENTS

Hereinafter, the present invention will be further described in details in combination with the accompanying drawings and the preferred embodiments.

Figure 1:
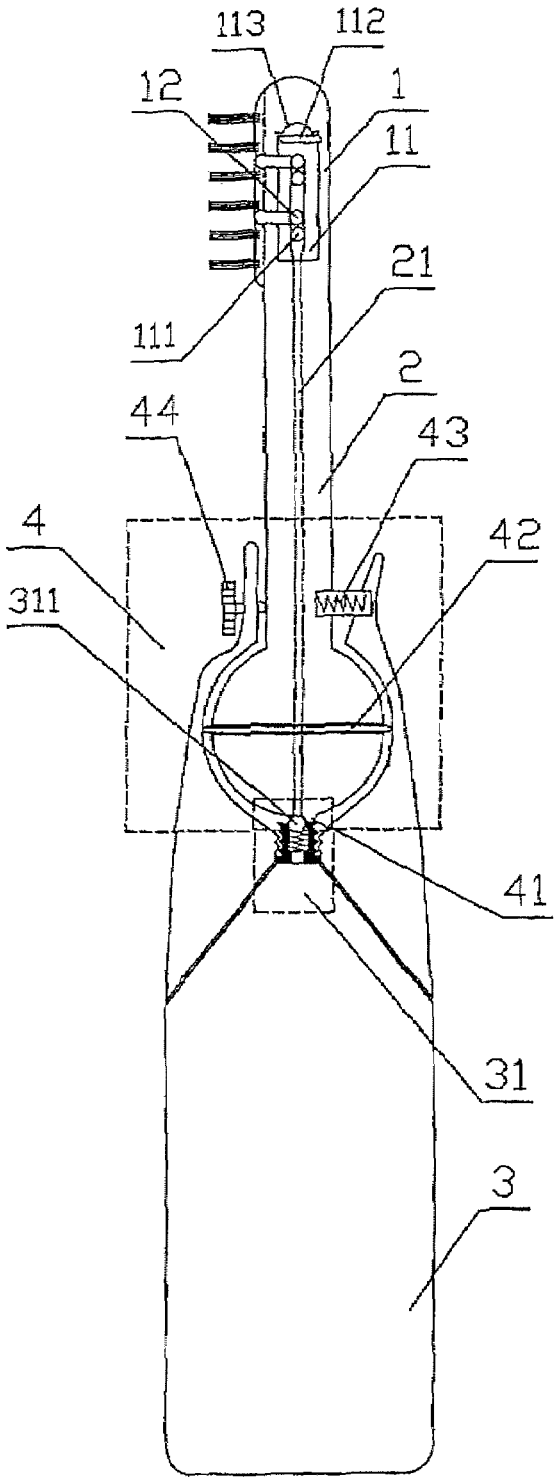
FIG. 1 is a schematic view showing the structure of embodiment 1 of the present invention.
Figure 2:
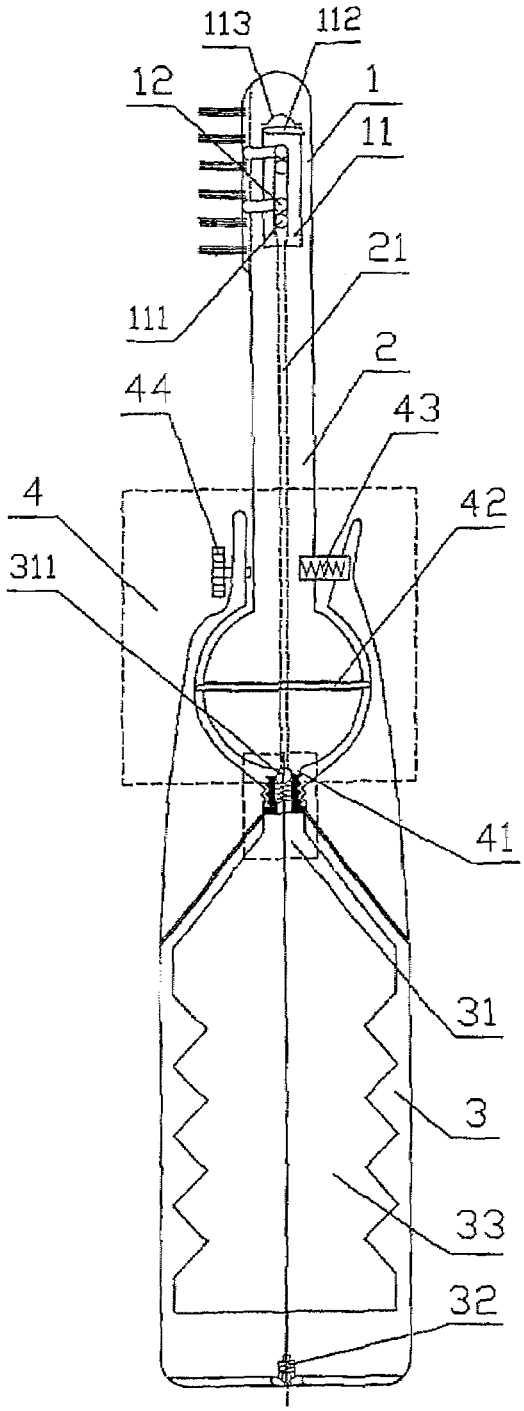
FIG. 2 is a schematic view showing the structure of embodiment 2 of the present invention.
Figure 3:
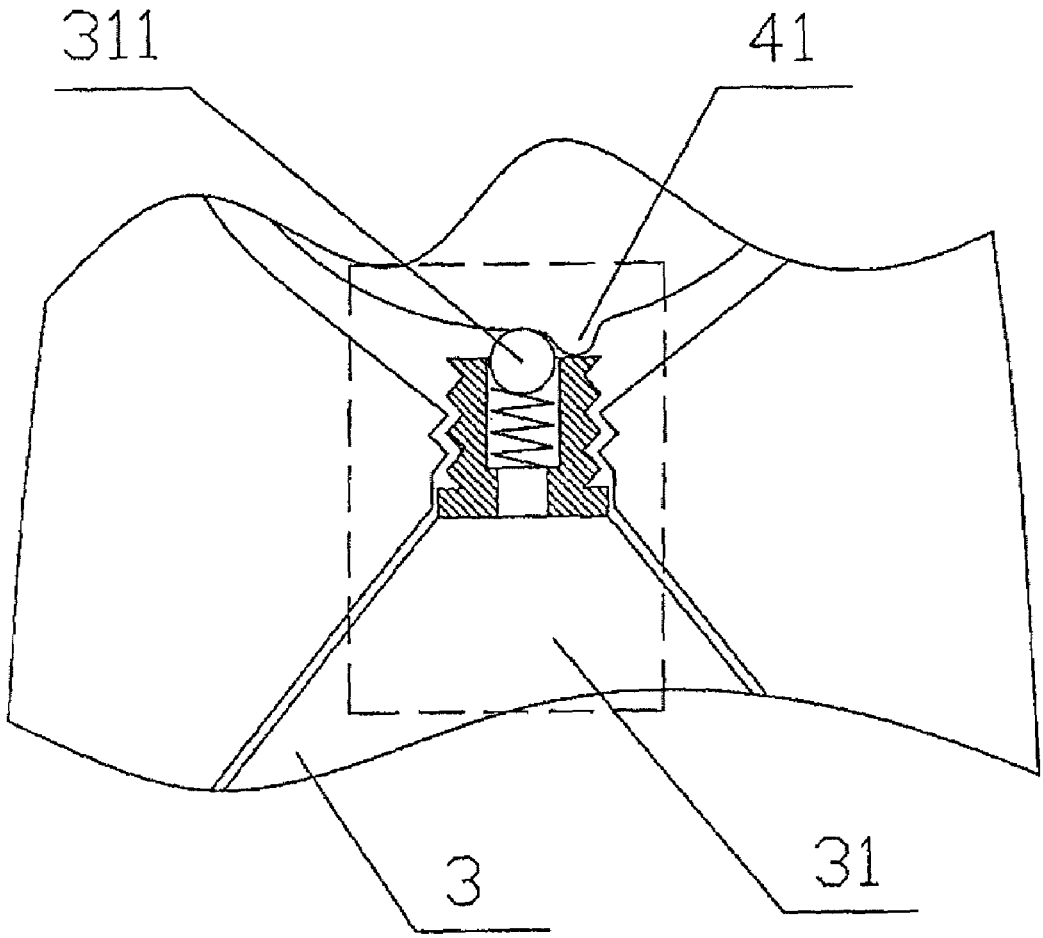
FIG. 3 is a partial enlarged view of the ball valve of the present invention.

As shown in FIG. 1, FIG. 2 and FIG. 3, the toothbrush of the present invention comprises a toothbrush head 1, a toothbrush bar 2 and a toothpaste container 3. Wherein, the toothpaste container 3, which is connected with the toothbrush bar 2, is a gas-filled and pressurized container, with a gas nipple 32 at the bottom of the container, and wherein a toothpaste bag 33, which is a compressible soft bag, is located inside the container. The toothbrush bar 2 has a pipe channel 21, and the toothbrush container 3 is communicated with the toothbrush head 1 through the pipe channel 21 via a valve. As shown in FIG. 1, the toothbrush bar 2 is hinged with the toothbrush container 3 by a spherical hinged joint 4 formed by the end of the toothbrush bar 2, and the spherical hinged joint 4 controls the opening or closing of the valve.

As shown in FIG. 1 and FIG. 2, the spherical hinged joint 4 has a protruding lip 41 located at its rear end. The valve is a ball valve 31 with its ball 311 set at the exit of the toothbrush container 3. The protruding lip 41 drives the ball 311 to move when the toothbrush bar 2 is rotated. In turn, the movement of the protruding lip 41 controls the opening or closing of the valve, namely, the rotation of the toothbrush bar 2 controls the opening or closing of the ball valve 31.

As shown in FIG. 1, the spherical hinged joint 4 is equipped with a leakproof ring 42, furthermore, a positioning spring 43 connected with the toothbrush bar 2 is provided to enable a reset of the toothbrush bar 2 by a relative rotation between the toothbrush bar 2 and the toothbrush container 3. As shown in FIG. 1, an adjusting button 44 is provided for adjusting the relative slanting angle between the toothbrush bar 2 and the toothbrush container 3. And as shown in FIG. 1 and FIG. 2 again, the spherical hinged joint 4 is screwed to the exit of the toothbrush container 3.

Figure 4:
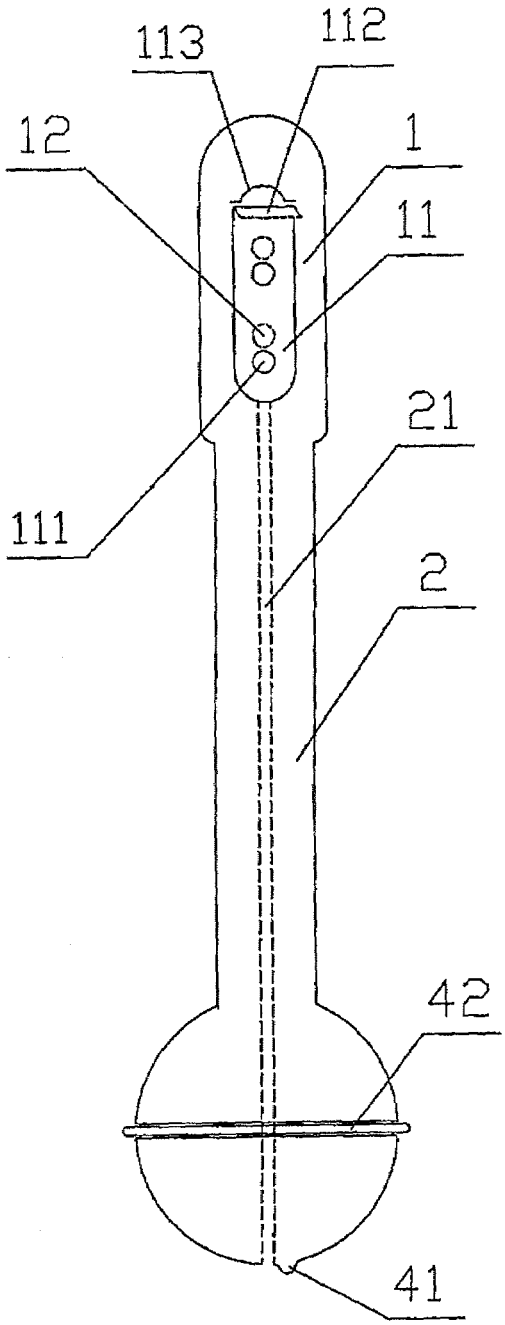
FIG. 4 is a schematic view showing the structure of the toothbrush bar and the vane valve of the present invention.

As shown in FIG. 1 and FIG. 4, a vane valve 11 is set inside the toothbrush head 1 for controlling the opening or closing of the pipe channel 21. The vane valve 11 has valve holes thereon, and inside the toothbrush head 1 are set corresponding through-holes extending to the bristle. The opening or closing of the vane valve 11 is controlled by the overlapping or misaligning between the valve hole 111 and trough-hole 12. The vane valve 11 is further provided with a protruding edge 112. When in use, the valve hole 111 is driven to move by the press to the protruding edge 112 from the toothpaste until the valve hole 111 is overlapped with the through-hole 12, such that the toothpaste is squeezed onto the bristle of the toothbrush head 1. A leaf spring 113 for reset is provided adjacent to the protruding edge 112.

The present invention may be operated in two manners. As shown FIG. 1, when the toothbrush bar 2 is pressed by teeth, the protruding lip 41 is driven to rotate, and pushes against the ball 311 simultaneously. Since the toothbrush container 3 is a pressurized container, toothpaste therein is discharged out of the exit of the toothbrush container 3 and flows through the pipe channel 21 to the vane valve 11 located inside the toothbrush head 1. The press to the protruding edge 112 by the toothpaste drives the valve hole 111 to move until the valve hole 111 overlaps with the through-hole 12, and then toothpaste is squeezed onto the bristle of the toothbrush head 1 via the through-hole 12.

An alternative manner is that, the adjusting button 44 is rotated first for adjusting the relative slanting angle between the toothbrush bar 2 and the toothbrush container 3, so as to make the adjusting button 44 push against the toothbrush bar 2 and set an appropriate slanting angle with respect to the toothbrush container 3. Similar to those mentioned above, the toothpaste is squeezed onto the bristle of the toothbrush head 1 via the through-hole 12. With this manner, the output amount of toothpaste can be increased or reduced according to individual habit.

After use or when not in use, the positioning spring 43 located in the spherical hinged joint 4 enables the reset of the toothbrush bar 2 by relative rotation between the toothbrush bar 2 and the toothbrush holder 3, namely the toothbrush bar 2 is reset. The exit of the toothbrush container 3 is blocked by the ball 311, and at the same time the reset spring 113 pushes the vane valve 11 to move until the valve hole 111 of the vane valve 11 is misaligned with the through-hole 12 in the toothbrush head 1, so as to avoid any leakage of toothpaste from the toothbrush head 1.

When the toothpaste in the toothbrush container 3 is exhausted, the toothbrush container 3 is disconnected from the screw connection between the exit and the spherical hinged joint 4, and is replaced with a new toothbrush container 3.

The invention claimed is:

1. A toothbrush comprising:

a toothbrush head, a toothbrush bar, and a toothpaste container which is connected with the toothbrush bar, wherein the toothbrush bar has a pipe channel, and the toothbrush container is communicated with the toothbrush head through the pipe channel via a first valve, and wherein the toothbrush bar is hinged with the toothbrush container by a spherical hinged joint formed by the end of the toothbrush bar, and the spherical hinged joint controls the opening or closing of the first valve.

2. A toothbrush according to claim 1, further comprising a vane valve inside said toothbrush head for controlling the opening or closing of the pipe channel.

3. A toothbrush according to claim 1, wherein said toothbrush container is a pressurized container.

4. A toothbrush according to claim 1, wherein said toothbrush container is a gas-filled container with a gas nipple at the bottom of the container, and wherein a toothpaste bag, which is a compressible soft bag, is located inside the container.

5. A toothbrush according to claim 1, wherein said spherical hinged joint has at least a protruding lip located at its rear end, and the protruding lip controls the opening or closing of the first valve when the toothbrush bar is rotated with respect to the toothbrush container.

6. A toothbrush according to claim 5, wherein said first valve is a ball valve in which the ball is disposed at the exit of the toothbrush container, and the protruding lip drives the ball to move when the toothbrush bar is rotated.

7. A toothbrush according to claim 1, wherein said spherical hinged joint includes a leakproof ring.

8. A toothbrush according to claim 1, further comprising a positioning spring to enable a reset of the toothbrush bar by a relative rotation between the toothbrush bar and the toothbrush container.

9. A toothbrush according to claim 1, further comprising an adjusting button for adjusting the relative slanting angle between the toothbrush bar and the toothbrush container.

10. A toothbrush according to claim 2, wherein said toothbrush container is a pressurized container.

11. A toothbrush according to claim 2, wherein said toothbrush container is a gas-filled container with a gas nipple at the bottom of the container, and wherein a toothpaste bag, which is a compressible soft bag, is located inside the container.

12. A toothbrush according to claim 2, wherein said spherical hinged joint has at least a protruding lip located at its rear end, and the protruding lip controls the opening or closing of the first valve when the toothbrush bar is rotated with respect to the toothbrush container.

13. A toothbrush according to claim 12, wherein said first valve is a ball valve in which the ball is disposed at the exit of the toothbrush container, and the protruding lip drives the ball to move when the toothbrush bar is rotated.

14. A toothbrush according to claim 2, wherein said spherical hinged joint includes a leakproof ring.

15. A toothbrush according to claim 2, further comprising a positioning spring to enable a reset of the toothbrush bar by a relative rotation between the toothbrush bar and the toothbrush container.

16. A toothbrush according to claim 2, further comprising an adjusting button for adjusting the relative slanting angle between the toothbrush bar and the toothbrush container.

* * * * *